US007637767B2

(12) United States Patent
Davis et al.

(10) Patent No.: US 7,637,767 B2
(45) Date of Patent: Dec. 29, 2009

(54) CABLE CONNECTOR ASSEMBLY

(75) Inventors: Wayne Samuel Davis, Harrisburg, PA (US); Robert Neil Whiteman, Jr., Middletown, PA (US); Julia Lachman, York, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/969,716

(22) Filed: Jan. 4, 2008

(65) Prior Publication Data

US 2009/0176400 A1 Jul. 9, 2009

(51) Int. Cl.
*H01R 13/627* (2006.01)

(52) U.S. Cl. ..... 439/352

(58) Field of Classification Search ..... 439/350, 439/352, 108, 608, 607, 610, 579, 750, 752
See application file for complete search history.

(56) References Cited

U.S. PATENT DOCUMENTS

| | | | | |
|---|---|---|---|---|
| 4,026,624 | A | 5/1977 | Boag | |
| 4,548,455 | A | 10/1985 | Ezure | |
| 4,632,121 | A | 12/1986 | Johnson et al. | |
| 4,681,387 | A | 7/1987 | Paddock | |
| 4,726,783 | A | 2/1988 | Nakazawa et al. | |
| 4,925,398 | A | 5/1990 | Samejima et al. | |
| 5,207,593 | A | 5/1993 | Bogiel | |
| 5,318,457 | A | 6/1994 | Harting et al. | |
| 5,330,366 | A | 7/1994 | Tsuji et al. | |
| 5,334,041 | A | 8/1994 | Anbo et al. | |
| 5,634,809 | A | 6/1997 | Hirai | |
| 5,919,056 | A | 7/1999 | Suzuki et al. | |
| 5,951,316 | A | 9/1999 | Kawano et al. | |
| 6,030,244 | A | 2/2000 | Buckheit et al. | |
| 6,113,416 | A | 9/2000 | Holzer | |
| 6,149,451 | A | 11/2000 | Weber | |
| 6,174,190 | B1 | 1/2001 | Tharp et al. | |
| 6,305,979 | B1 * | 10/2001 | Ko | 439/579 |
| 6,338,652 | B1 * | 1/2002 | Ko | 439/579 |
| 6,338,653 | B1 * | 1/2002 | Jones et al. | 439/579 |
| 6,358,081 | B1 | 3/2002 | Saka et al. | |
| 6,368,140 | B2 | 4/2002 | Torii | |
| 6,386,898 | B1 | 5/2002 | Taguchi | |
| 6,475,014 | B2 | 11/2002 | Tsuji et al. | |
| 6,494,732 | B2 | 12/2002 | Kashiyama et al. | |
| 6,497,585 | B2 | 12/2002 | Torii | |
| 6,592,390 | B1 | 7/2003 | Davis et al. | |
| 6,743,057 | B2 | 6/2004 | Davis et al. | |
| 6,749,468 | B2 | 6/2004 | Avery | |
| 6,823,587 | B2 * | 11/2004 | Reed | 29/858 |
| 6,893,295 | B1 * | 5/2005 | Lloyd et al. | 439/610 |
| 7,081,002 | B2 * | 7/2006 | de Vanssay et al. | 439/350 |
| 7,390,218 | B2 * | 6/2008 | Smith et al. | 439/608 |

* cited by examiner

*Primary Examiner*—Alexander Gilman

(57) ABSTRACT

A connector assembly includes a housing having support walls extending between a loading end and a mating end that define a mating interface. A contact module is received within the housing through the loading end, and the contact module includes contacts, a body and a plurality of conductors held by the body. The conductors extend between mating ends and wire terminating ends, and the contacts extend from the mating ends of the conductors at the mating interface of the housing. The wire terminating ends are configured to be terminated to individual wires of a cable. A clip has a first securing tab and a second securing tab, wherein the first securing tab is securely coupled to the housing and the second securing tab is securely coupled to the contact module. The clip securely retains the contact module within the housing.

20 Claims, 13 Drawing Sheets

CABLE CONNECTOR ASSEMBLY

BACKGROUND OF THE INVENTION

The subject matter herein relates generally to cable connector assemblies, and more particularly, to high speed, differential cable connector assemblies.

With the ongoing trend toward smaller, faster, and higher performance electrical components such as processors used in computers, routers, switches, etc., it has become increasingly desirable for the electrical interfaces along the electrical paths to also operate at higher frequencies and at higher densities with increased throughput. For example, performance demands for video, voice and data drive input and output speeds of connectors within such systems to increasingly faster levels.

Electrical connectors typically are arranged to be connected to complementary connector halves to form connector pairs. One application environment that uses such electrical connectors is in high speed, differential electrical connectors, such as those common in the telecommunications or computing environments. In a traditional approach, two circuit boards are interconnected with one another in a backplane and a daughter board configuration. However, similar types of connectors are also being used in cable connector to board connector applications. With the cable connector to board configuration, one connector, commonly referred to as a header, is board mounted and includes a plurality of signal contacts which connect to conductive traces on the board. The other connector, commonly referred to as a cable connector or a receptacle, includes a plurality of contacts that are connected to individual wires in one or more cables of a cable assembly. The receptacle mates with the header to interconnect the backplane with the cables so that signals can be routed therebetween.

However, such cable connectors are not without problems. Typically the connections of the wires to the contacts are susceptible to damage and/or failure, such as due to strain on the cables. One solution to this type of problem is to provide strain relief on the cables and/or the interface of the wires with the contacts. Such solutions have heretofore proven difficult.

A need remains for a cable connector that overcomes at least some of the existing problems of damage or failure at the interconnection of the wires with the cable connector in a cost effective and reliable manner.

BRIEF DESCRIPTION OF THE INVENTION

In one embodiment, a connector assembly is provided including a housing having support walls extending between a loading end and a mating end that define a mating interface. A contact module is received within the housing through the loading end, and the contact module includes contacts, a body and a plurality of conductors held by the body. The conductors extend between mating ends and wire terminating ends, and the contacts extend from the mating ends of the conductors at the mating interface of the housing. The wire terminating ends are configured to be terminated to individual wires of a cable. A clip has a first securing tab and a second securing tab, wherein the first securing tab is securely coupled to the housing and the second securing tab is securely coupled to the contact module. The clip securely retains the contact module within the housing.

Optionally, the first securing tab may include at least one tab extending from the clip proximate to a first end, and the second securing tab may include at least one tab extending from the clip proximate to a second end. The clip resists removal of the contact module from the housing in the direction of the wires. Optionally, the body may include a rib extending outward therefrom, wherein the rib is received in a slot in one of the support walls, and the clip may extend through the support wall and engages the rib.

In another embodiment, a connector assembly is provided that includes a first connector having a housing having support walls extending between a loading end and a mating end that defines a mating interface, and a contact module received within the housing through the loading end. The contact module has a body, a plurality of mating contacts extending from the body and a plurality of conductors held by the body and electrically connected to respective ones of the mating contacts. The conductors are configured to be terminated to individual wires of a cable. The first connector further includes a clip coupled to at least one of the support walls of the housing and coupled to the body of the contact module to securely retain the contact module within the housing. The clip has an actuator retention feature, and the first connector further includes a latching feature and an actuator movable with respect to the latching feature. The actuator is movably coupled to the actuator retention feature of the clip and is movable between a first position and an actuated position. The connector assembly also includes a second connector having a second housing having a second mating interface matable with the mating interface of the first connector and a plurality of second mating contacts held within the housing for mating with the mating contacts of the first connector. The second connector further includes a movable latch matable with the latching feature when the first and second connectors are joined. The latch is moved by the actuator from a locked position to a released position, wherein the latch locks the latching feature when the latch is in the locked position and the latch is released from the latching feature when the latch is in the released position.

In a further embodiment, a connector assembly is provided that includes a housing having support walls extending between a loading end and a mating end defining a mating interface, and a plurality of substantially identically formed contact modules received within the housing through the loading end. Each contact module includes contacts, a body and a plurality of conductors held by the body. The conductors are arranged in sets of first, second and third conductors configured to operate in one of a signal-signal-ground conductor pattern and a ground-signal-signal conductor pattern. The conductor pattern is defined by a commoning member configured to be directly electrically connected to certain ones of the conductors defining ground conductors. The orientation of the commoning member with respect to the body may be changed to change the conductor pattern.

DETAILED DESCRIPTION OF THE INVENTION

Figure 1:
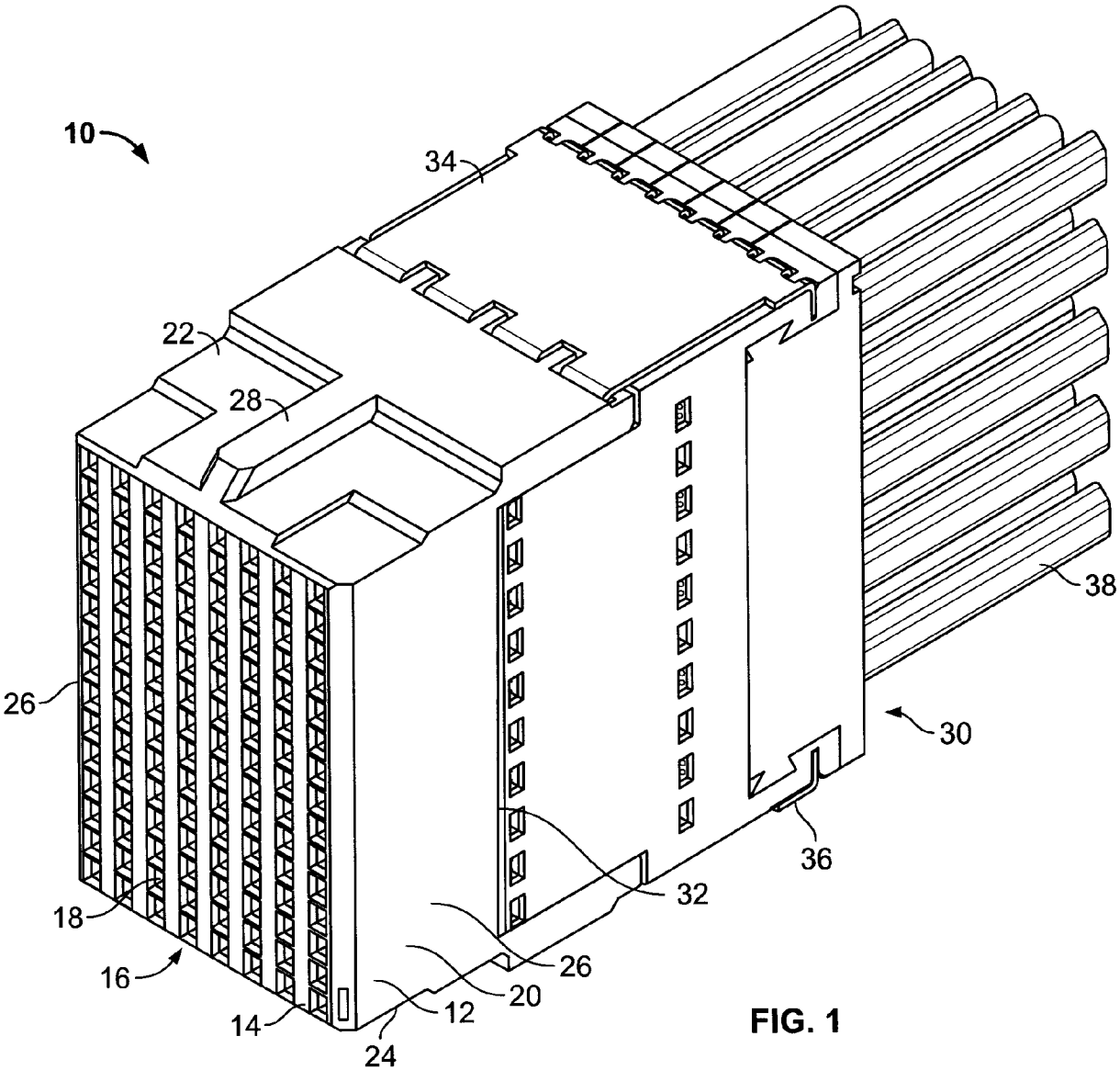
FIG. 1 is a front perspective view of a receptacle connector assembly formed in accordance with an exemplary embodiment.

FIG. 1 is a front perspective view of a receptacle connector assembly 10 formed in accordance with an exemplary embodiment. The receptacle connector assembly 10 is matable with a header connector assembly (not shown) to create a differential connector system. For example, the header connector assembly may be a Z-PACK TinMan header connector, which is commercially available from Tyco Electronics. While the receptacle connector assembly 10 will be described with particular reference to a high speed, differential cable connector, it is to be understood that the benefits herein described are also applicable to other connectors in alternative embodiments. The following description is therefore provided for purposes of illustration, rather than limitation, and is but one potential application of the subject matter herein.

As illustrated in FIG. 1, the receptacle connector assembly 10 includes a dielectric housing 12 having a forward mating end 14 that includes a mating interface 16 and a plurality of contact cavities 18. The contact cavities 18 are configured to receive corresponding mating contacts (not shown) from the header connector assembly. The housing 12 includes a plurality of support walls 20, including an upper shroud wall 22, a lower shroud wall 24 and side walls 26. Alignment ribs 28 are formed on the upper shroud wall 22 and lower shroud wall 24. The alignment ribs 28 cooperate to bring the receptacle connector assembly 10 into alignment with the header connector assembly during the mating process so that the mating contacts of the mating connector are received in the contact cavities 18 without damage.

A plurality of contact modules 30 are received in the housing 12 from a rearward loading end 32 of the housing 12. First and second clips 34, 36 are used to securely couple the contact modules 30 to the housing 12. Cables 38 are terminated to the contact modules 30. The receptacle connector assembly 10 thus defines a cable connector.

Figure 2:
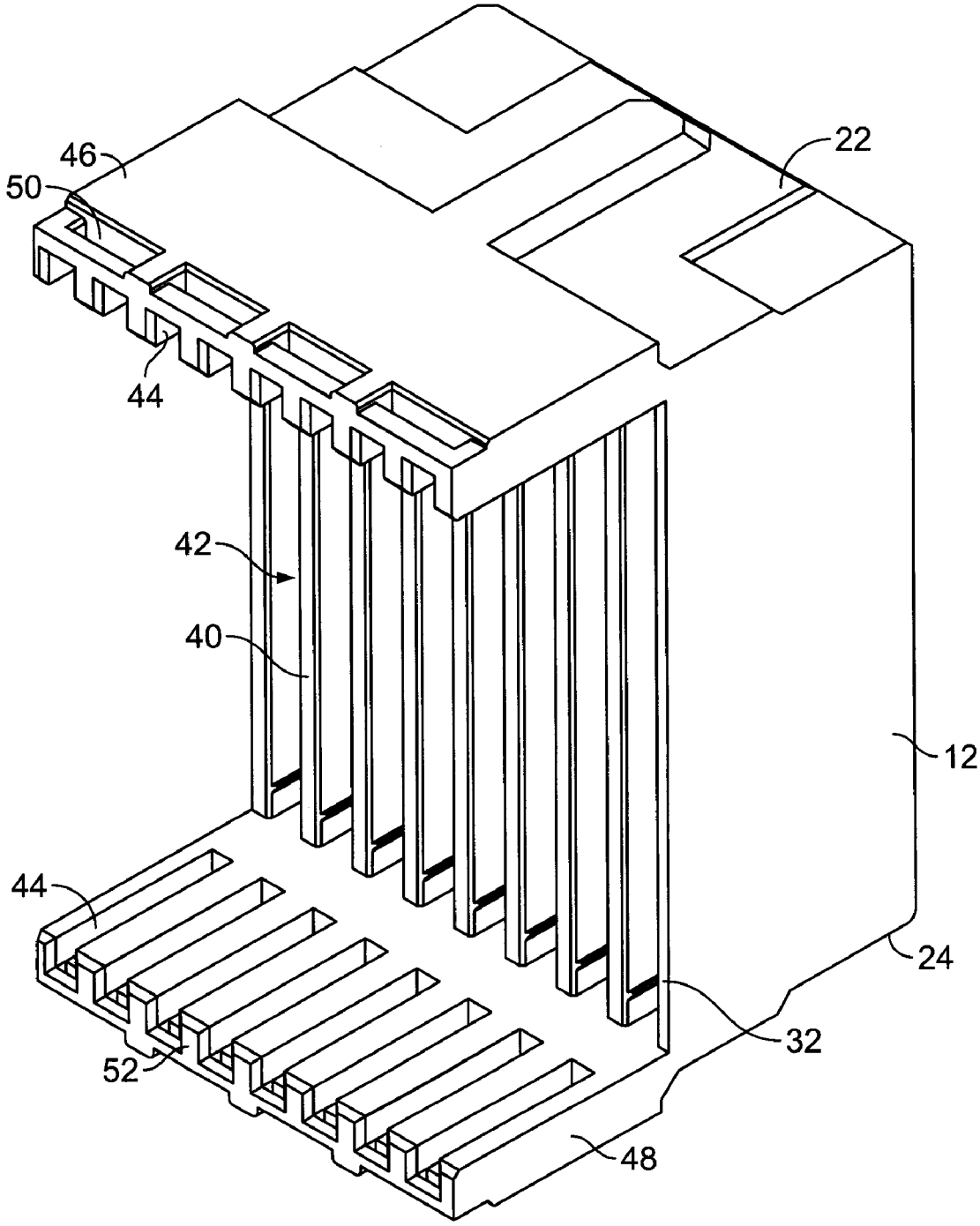
FIG. 2 is a rear perspective view of a housing for the receptacle connector assembly shown in FIG. 1.

FIG. 2 is a rear perspective view of the housing 12 for the receptacle connector assembly 10 (shown in FIG. 1). The housing 12 includes a plurality of dividing walls 40 that define a plurality of chambers 42. The chambers 42 receive a forward portion of the contact modules 30 (shown in FIG. 1). A plurality of slots 44 are formed in upper and lower hood portions 46, 48 that extend rearwardly from the loading end 32 of the housing 12. The hood portions 46, 48 generally form extensions of the upper and lower shroud walls 22, 24, respectively. The slots 44 may have equal width. The chambers 42 and slots 44 cooperate to stabilize the contact modules 30 when the contact modules 30 are loaded into the housing 12.

In an exemplary embodiment, openings 50, 52 are formed in the hood portions 46, 48, respectively. The openings 50, 52 are positioned proximate to a rearward end of the hood portions 46, 48. The clips 34, 36 (shown in FIG. 1) may be received within the openings 50, 52, respectively, when the receptacle connector assembly 10 is assembled. Optionally, the openings 50, 52 may extend at least partially through the hood portions 46, 48 such that the openings 50, 52 open to the slots 44.

Figure 3:
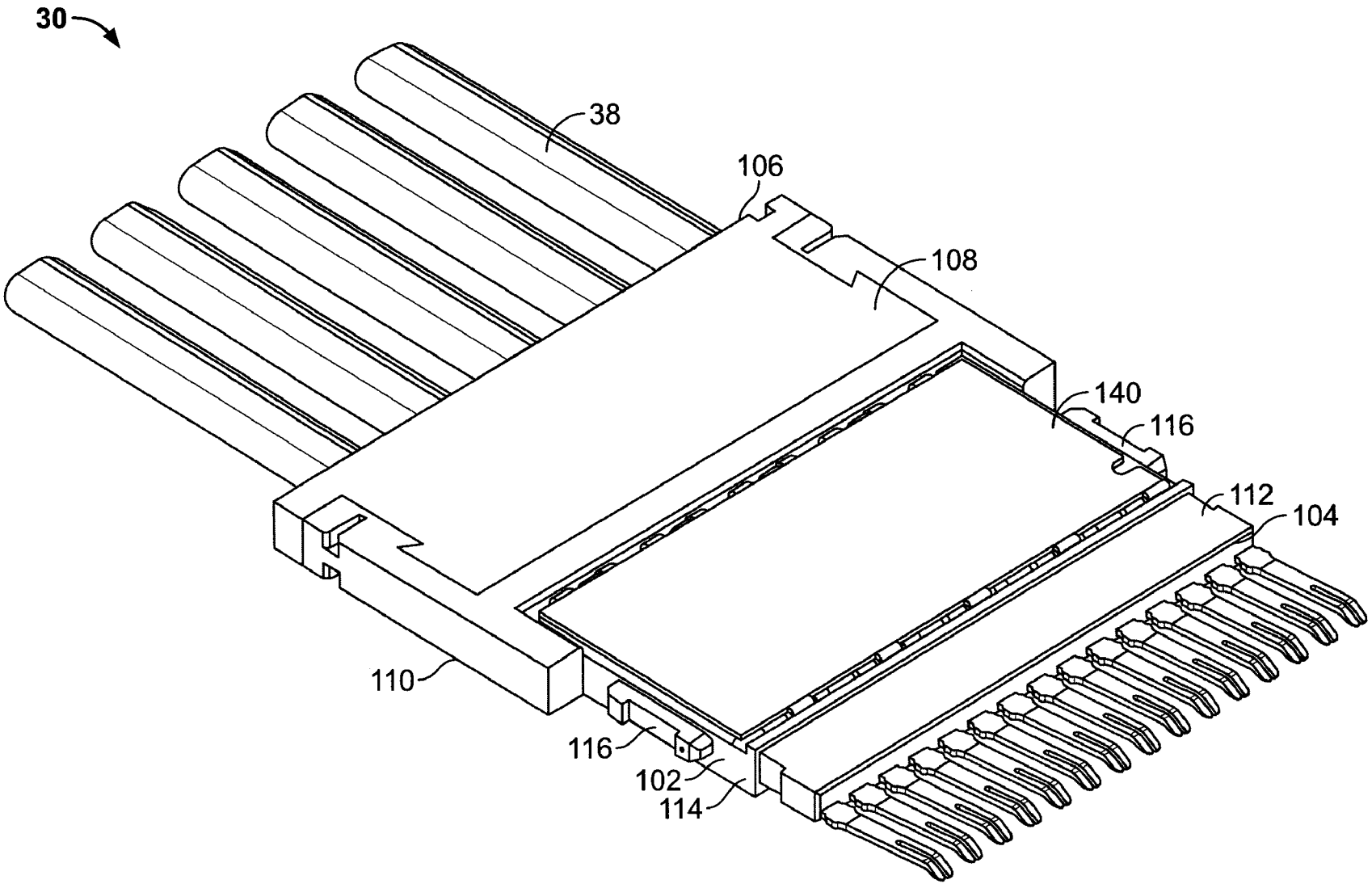
FIG. 3 is a perspective view of a contact module that is matable with the housing shown in FIG. 2 to form the receptacle connector assembly shown in FIG. 1.
Figure 4:
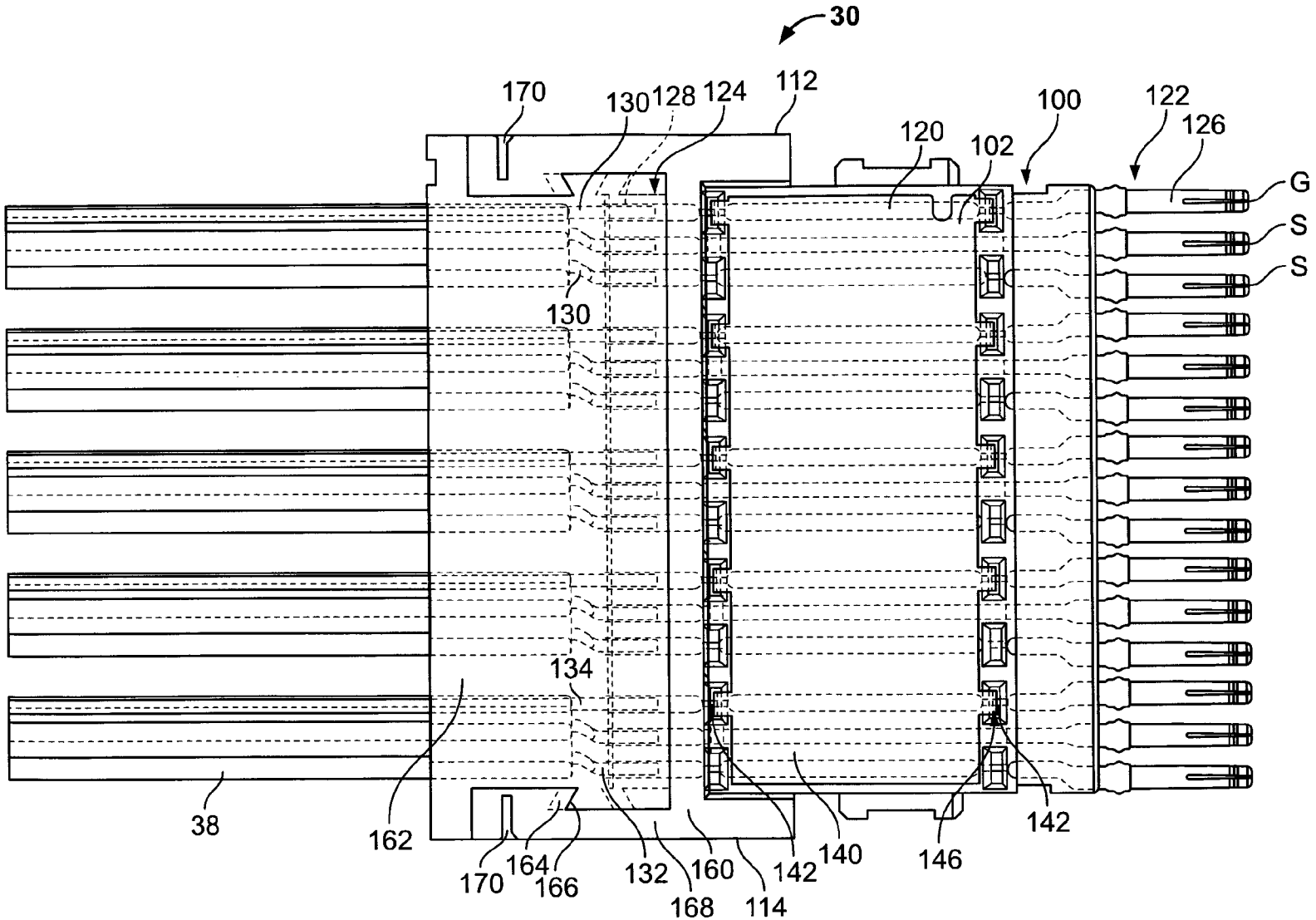
FIG. 4 schematically illustrates an internal structure, including a leadframe, of the contact module shown in FIG. 3.

FIG. 3 is a perspective view of one of the contact modules 30 that is matable with the housing 12 (shown in FIG. 2) to form the receptacle connector assembly 10 (shown in FIG. 1). FIG. 4 illustrates an internal structure, including an internal lead frame 100, of the contact module 30 in phantom. The contact module 30 includes a dielectric body 102 that surrounds the lead frame 100. In some embodiments, the body 102 is manufactured using an over-molding process. During the molding process, the lead frame 100 is encased in a dielectric material, such as a plastic material, which forms the body 102. Optionally, the contact module 30 may be manufactured in stages that include more than one overmolding processes (e.g. an initial overmolding and a final overmolding).

As illustrated in FIG. 3, the body 102 extends between a forward mating end 104 and a rear end 106. The cables 38 extend rearward from the rear end 106. The body 102 includes opposed first and second generally planar side surfaces 108 and 110, respectively. The side surfaces 108 and 110 extend substantially parallel to and along the lead frame 100. The body 102 includes opposed top and bottom ends 112, 114. Optionally, ribs 116 may be provided on each of the top and bottom ends 112, 114. The ribs 116 may be used to guide and/or orient the contact modules 30 into or within the slots 44 and/or chambers 42 of the housing 12 (shown in FIG. 2).

As illustrated in FIG. 4, the lead frame 100 includes a plurality of conductors 120 that extend between mating ends 122 and wire terminating ends 124. Mating contacts 126 are provided at the mating ends 122, and the mating contacts 126 are loaded into the contact cavities 18 (shown in FIG. 1) of the housing 12 for mating with corresponding mating contacts of the header connector assembly (not shown). The conductors 120 define wire mating portions proximate to the wire terminating ends 124. For example, the conductors 120 may include solder pads 128 at the wire terminating ends 124 for terminating to respective wires 130 of the cable 38 by soldering. Other terminating processes and/or features may be provided at the wire terminating ends 124 for terminating the wires 130 to the conductors 120. For example, insulation displacement contacts, wire crimp contacts, and the like may be provided at the wire terminating ends 124. The mating contacts 126 and/or the solder pads 128 may be formed integrally with the conductors 120, such as by a stamping and/or forming process, or the mating contacts 126 and/or the solder pads 128 may be separately provided and electrically connected to the conductors 120.

In an exemplary embodiment, the conductors 120 are arranged generally parallel to one another between the mating ends 122 and wire terminating ends 124, and the mating ends 122 and the wire terminating ends 124 are provided at generally opposite ends of the contact module 30. However, other configurations of conductors 120 may be provided in alternative embodiments, such that the conductors 120 and/or at least one of the mating and/or wire terminating ends 122, 124 have different arrangements or positions. The conductors 120 are grouped together and arranged in a predetermined pattern of signal, ground and/or power conductors. In the illustrated embodiment, the conductors 120 are arranged in groups of three conductors 120 that have two signal conductors carrying differential signals and one ground conductor. The group of conductors 120 are adapted for connection with cables 38 having two differential signal wires 132 and a ground wire 134. In one embodiment, as illustrated in FIG. 4, the pattern of conductors 120 is a ground-signal-signal pattern (from the top end 112 to the bottom end 114 of the body 102). As such, a ground conductor is arranged between each adjacent pair of signal conductors. In another embodiment, the pattern of conductors 120 is a signal-signal-ground pattern (from the top end 112 to the bottom end 114 of the body 102). As such, a ground conductor is arranged between each adjacent pair of signal conductors.

In an exemplary embodiment, the lead frame 100 and body 102 are universal, such that the pattern of conductors 120 may be established by the coupling of the signal or ground wires 132, 134 to the conductors 120. For example, if the ground wire 134 is terminated to the top-most conductor 120 of each grouping, then the contact module 30 will have a ground-signal-signal pattern, whereas, if the ground wire 134 is terminated to the bottom-most conductor 120 of each grouping, then the contact module 30 will have a signal-signal-ground pattern. As such, the same contact modules 30 may be mated within the housing 12, but the patterns of the conductors 120 of different ones of the contact modules 30 within the housing 12 may be different. For example, adjacent ones of the contact modules 30 within the housing 12 may have different patterns of conductors 120.

Figure 5:
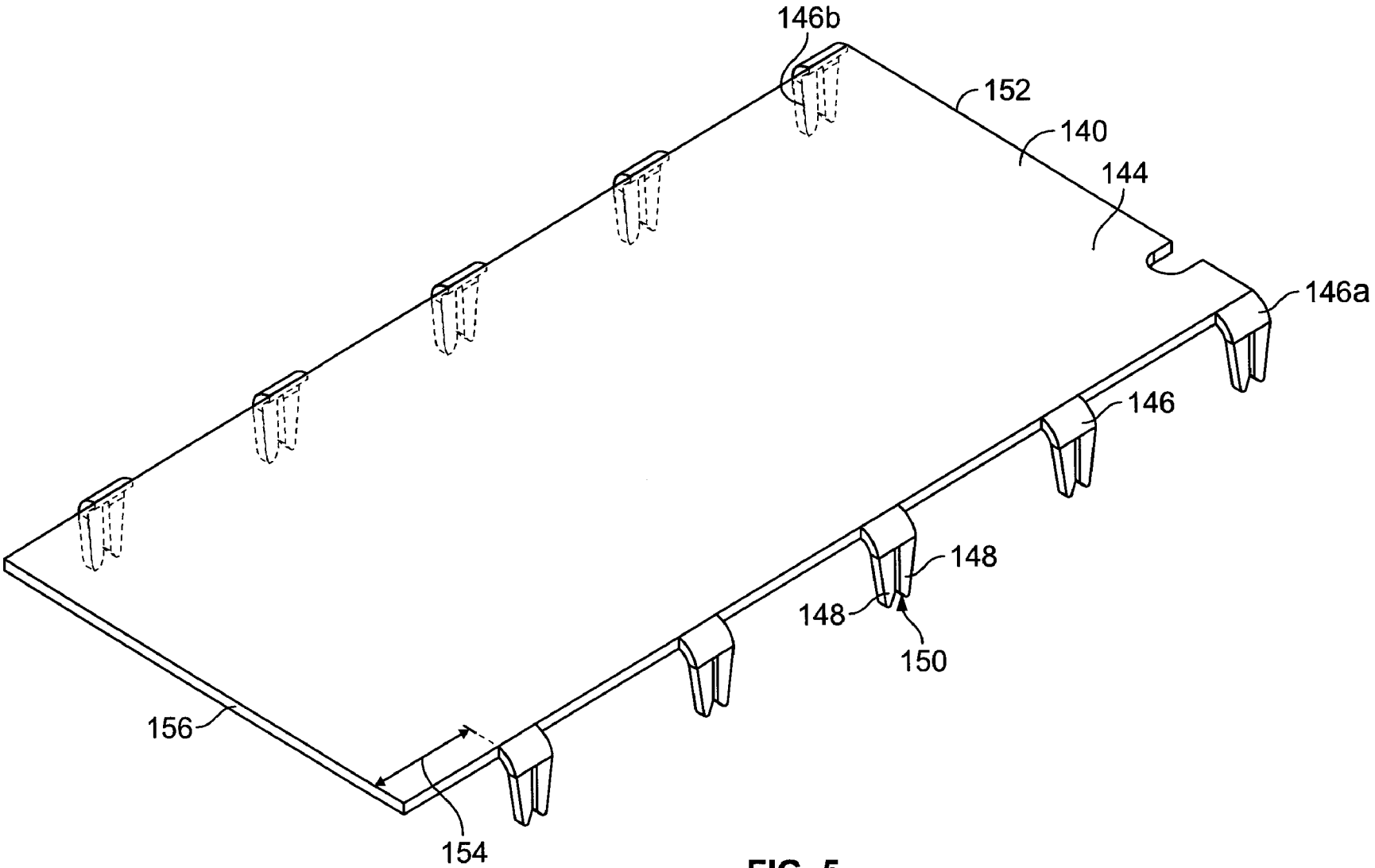
FIG. 5 illustrates a commoning member formed in accordance with an exemplary embodiment and useable with the contact module shown in FIG. 3.

In an exemplary embodiment, the contact module 30 may include a commoning member 140, shown in further detail in FIG. 5. The commoning member 140 may be used to define which of the conductors 120 of the lead frame 100 define ground conductors. When connected, the commoning member 140 interconnects and electrically commons each of the ground conductors to which the commoning member 140 is connected. For example, the commoning member 140 may be mechanically and electrically connected to each of the ground conductors within the lead frame 100. In an exemplary embodiment, certain ones of the conductors 120 may include grounding portions 142 to which the commoning member 140 is connected. Optionally, the commoning member 140 may connect to the ground conductors at multiple points along each ground conductor, such as proximate to the mating end 122 and the wire terminating end 124 thereof. In an exemplary embodiment, and as described in further detail below, the orientation of the commoning member 140 with respect to the body 102 may define the conductor pattern (e.g. ground-signal-signal versus signal-signal-ground).

FIG. 5 illustrates the commoning member 140 formed in accordance with an exemplary embodiment and useable with the contact module 30 (shown in FIG. 3). The commoning member 140 includes a planar body 144 having a plurality of grounding tabs 146 extending perpendicularly from one side of the body 144. Optionally, the grounding tabs 146 may be arranged in sets (such as the set of grounding tabs identified as 146*a* and 146*b*), wherein the grounding tabs 146 of each set are configured to be connected to the same ground conductor 120 (shown in FIG. 4) of the contact module 30. In one embodiment, the grounding tabs 146 each include resilient beams 148 that have a gap 150 therebetween. When assembled, the ground conductor is received within the gap 150 and captured between the beams 148 such that a mechanical and electrical connection is made therebetween, similar to an IDC type of connection. In one embodiment, the ground conductor is necked down (e.g. has a reduced cross-section) at the grounding portion 142 to facilitate the connection with the grounding tabs 146.

In one embodiment, the commoning member 140 is universal, and may be connected to the contact module 30 independent of the pattern of the conductors 120. For example, the orientation of the commoning member 140 with respect to the contact module 30 may be changed such that the same commoning member 140 may be used for a signal-signal-ground or a ground-signal-signal arrangement of the conductors 120. In an exemplary embodiment, each set of grounding tabs 146 are spaced equally apart from one another. One set of grounding tabs 146 is positioned at, or proximate to, an outer edge 152 of the body 144, while another set of grounding tabs 146 is positioned a distance 154 from another outer edge 156.

Figure 6:
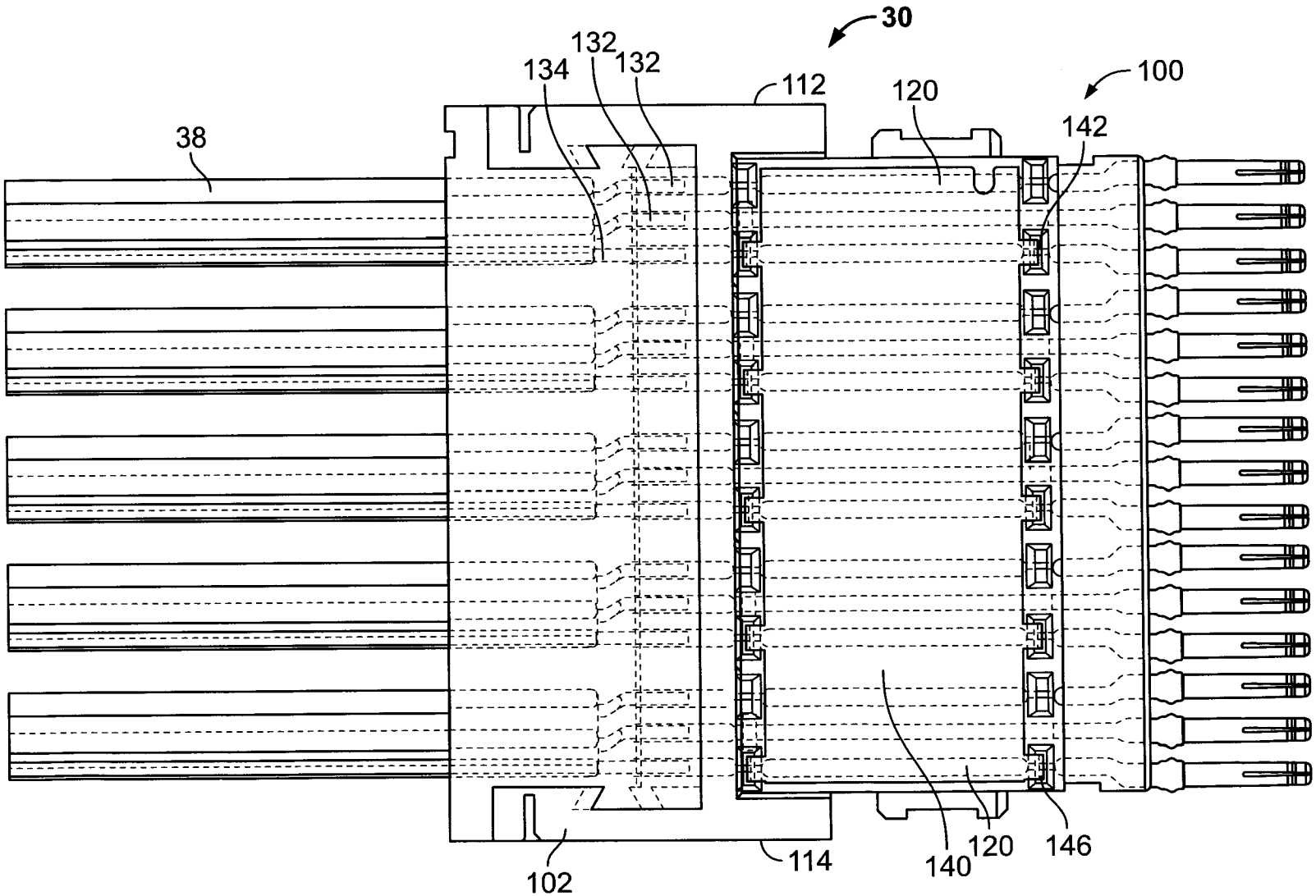
FIG. 6 schematically illustrates the internal structure of the contact module, with the commoning member shown in FIG. 5 in a different orientation as the orientation illustrated in FIG. 4.

Referring back to FIG. 4, when the commoning member 140 is positioned in a first orientation, as illustrated in FIG. 4, each of the grounding tabs 146 are aligned with and connect with the top-most conductors 120 in each group of conductors 120, which are the ground conductors of each group of conductors. However, if the commoning member 140 is rotated top to bottom (as shown in FIG. 6), each of the grounding tabs 146 would be aligned with and connect with the bottom-most conductors 120 in each group of conductors 120. The commoning member 140 may be coupled to the conductors 120 in other ways, such as by sliding the commoning member 140 up or down the contact module 30 to align the grounding tabs 146 with different combinations of conductors 120. In an exemplary embodiment, the body 102 includes a plurality of openings therethrough which expose the conductors 120, and the grounding tabs 146 extend into the openings to engage the conductors 120.

FIG. 6 illustrates the internal structure, including the internal lead frame 100, of the contact module 30 in phantom, with the commoning member 140 in a different orientation as illustrated in FIG. 4. FIG. 6 illustrates substantially the same contact module 30 as illustrated in FIG. 4, however, the conductor pattern of the contact module 30 illustrated in FIG. 6 is different than the conductor pattern illustrated in FIG. 4. In FIG. 6, the group of conductors 120 are adapted for connection with cables 38 having two differential signal wires 132 and a ground wire 134. The pattern of conductors 120 is a signal-signal-ground pattern (from the top end 112 to the bottom end 114 of the body 102). As such, a ground conductor is arranged between each adjacent pair of signal conductors. The grounding tabs 146 of the commoning member 140 are aligned with and connect with the grounding portions 142 of the bottom-most conductors 120 in each group of conductors 120, which are the ground conductors of each group of conductors.

An exemplary manufacture or assembly of the contact module 30 may be described with reference to FIG. 4. As described above, the body 102 may be overmolded over the lead frame 100 in a multiple step process. For example, the lead frame 100 may be initially overmolded such that the solder pads 128 are exposed rearward of a frame element 160 of the body 102. The wires 130 of the cable 38 may then be terminated to the solder pads 128. After the wires 130 are terminated, the body 102 may be overmolded a second time, forming an insert portion 162 of the body 102. The insert portion 162 is overmolded around the cables 38 and wires 130 to securely retain the cables 38 and wires 130 within the contact module 30 and/or to provide strain relief to resist pulling of the wires 130 away from the solder pads 128.

The insert portion 162 is coupled to the frame element 160, such as by forming keys 164, 166 in the frame element 160 and insert portion 162. Because the frame element 160 and the insert portion 162 are individually molded, a line of weakness may be created between the frame element 160 and the insert portion 162. Excessive strain, such as pulling on the cables 38, may cause the insert portion 162 to separate from, or pull away from, the frame element 160, which may also break the electrical connection between the wires 130 and the conductors 120. For example, frame element arms 168 of the frame element 160 may bow or flex outward, which may cause separation of the insert portion 162 from the frame element 160. In an exemplary embodiment, and as described in further detail below, the clips 34, 36 (shown in FIG. 1) are used to add stability to the body 102 to resist such separation of the insert portion 162 from the frame element 160. For example, the frame element 160 may include slots 170 for receiving the clips 34, 36 therein.

Figure 7:
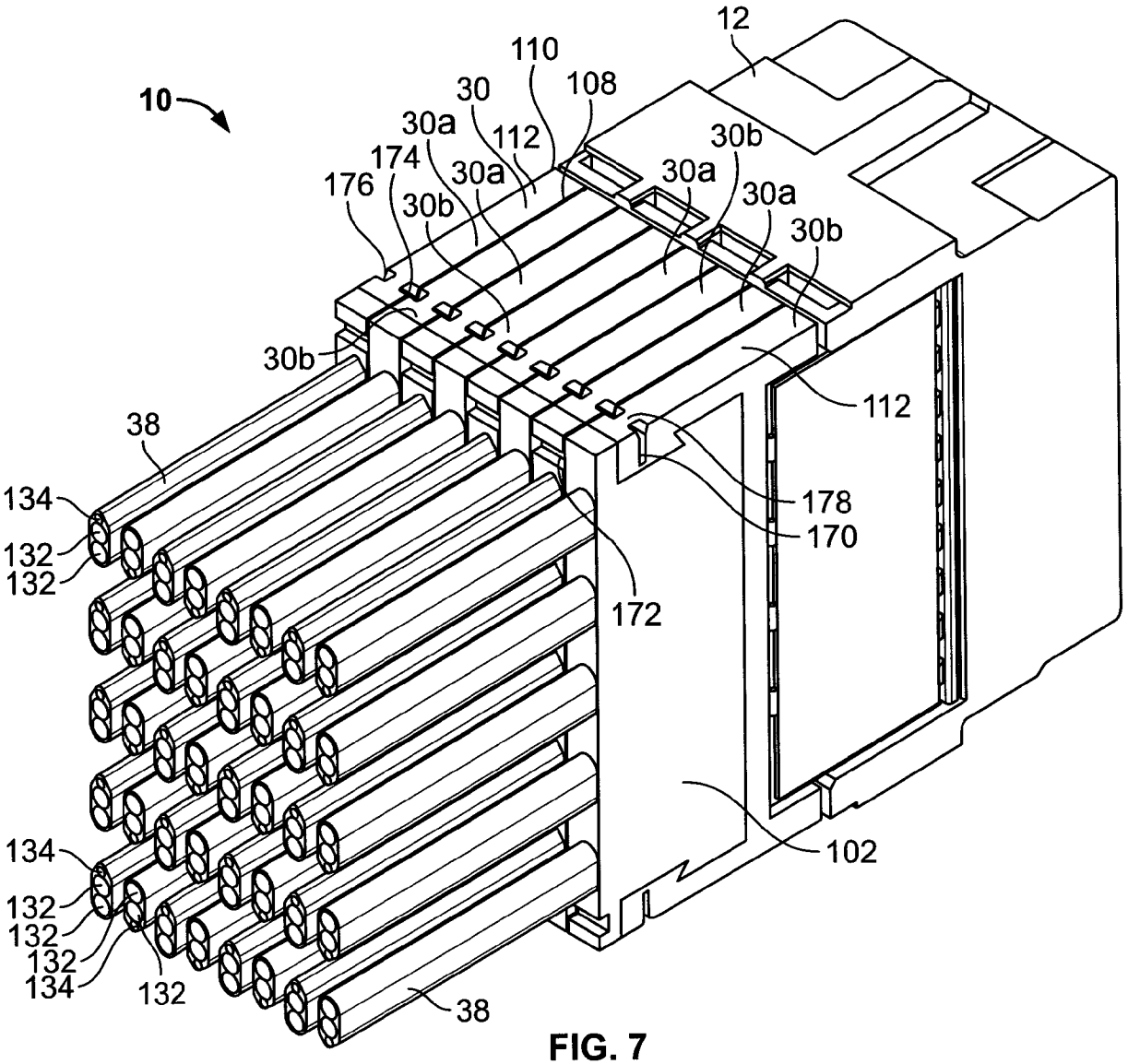
FIG. 7 is a rear perspective view of the receptacle connector assembly shown in FIG. 1 in a partially assembled state.

FIG. 7 is a rear perspective view of the receptacle connector assembly 10 in a partially assembled state. The contact modules 30 are plugged into the chambers 42 (shown in FIG.

2) of the housing 12. Optionally, the contact modules 30 may be resiliently retained within the chambers 42, such as by a friction fit and/or with barbs on the contacts 126. In the illustrated embodiment, the contact modules 30 are arranged within the housing 12 such that adjacent ones of the contact modules 30 have different patterns of conductors 120 (shown in FIG. 4). For example, some of the contact modules 30A have conductors arranged with a first pattern of conductors arranged as ground-signal-signal (when viewed from the top end 112) and others of the contact modules 30B have conductors arranged with a second pattern of conductors arranged as signal-signal-ground (when viewed from the top end 112). In an exemplary embodiment, the contact modules 30A and 30B are substantially identically formed, but the connection of the wires and/or the orientation of the commoning member 140 may determine the pattern of the conductors.

Additionally, as illustrated in FIG. 7, the cables 38 associated with the contact modules 30A having the first pattern each include the ground wires 134 on the top of the pair of signal wires 132, whereas the cables 38 associated with the contact modules 30B having the second pattern each include the ground wires 134 on the bottom of the pair of signal wires 132. A notch 172 may be provided on the body 102 of each contact module 30, wherein the notch 172 provides a visual indication of the type of contact module 30 when plugged into the housing 12. For example, the contact modules 30A having the first pattern each provide the notch 172 proximate to the top end 112, whereas the contact modules 30B having the second pattern each provide the notch 172 proximate to the bottom end 112.

In an exemplary embodiment, the slots 170 are provided in the bodies 102 of the contact modules 30 for receiving the clips 34, 36. In an exemplary embodiment, a first slot 174 extends inwardly from each first side surface 108 of each body 102 and a second slot 176 extends inwardly from each second side surface 110 of each body 102. The body forms a web 178 between each of the first and second slots 174, 176. When the contact modules 30 are arranged within the housing 12, the slots 174, 176 of each adjacent contact module 30 are aligned with one another, such that a first slot 174 of one contact module 30 opens to a second slot 176 of an adjacent contact module 30. The clips 34, 36 may thus engage more than one contact module 30 when assembled, which may hold adjacent ones of the contact modules 30 substantially in place relative to one another. The clips 34, 36 may prevent adjacent contact modules 30 from spreading apart from one another, in essence locking each of the contact modules 30 together, to provide rigidity to the contact modules 30.

Figure 8:
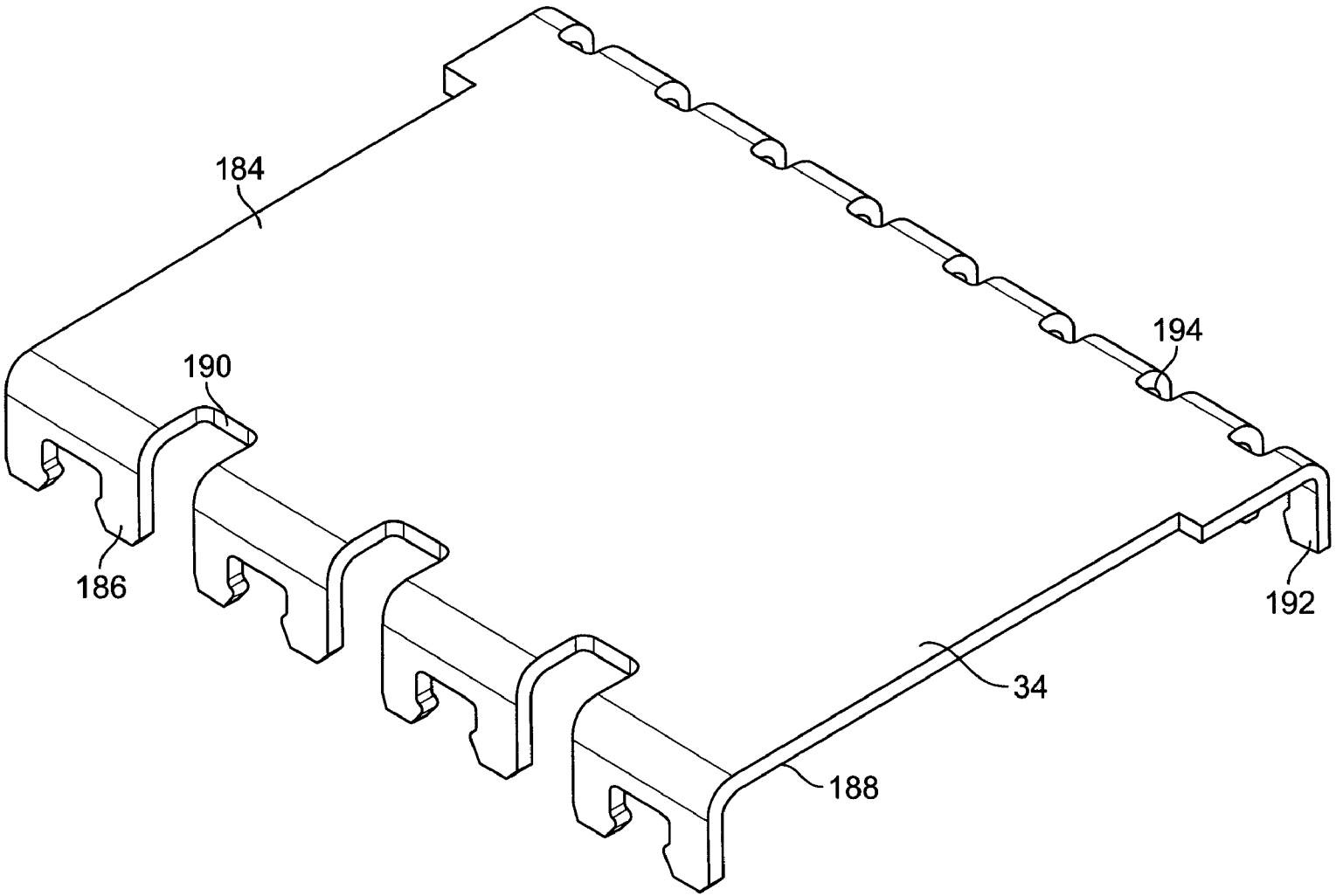
FIG. 8 illustrates a clip formed in accordance with an exemplary embodiment and usable with the receptacle connector assembly shown in FIG. 1.

FIG. 8 illustrates the clip 34 (which may be the same as the clip 36) formed in accordance with an exemplary embodiment and usable with the receptacle connector assembly 10 (shown in FIG. 1). The clip 34 includes a planar body 184 having a plurality of first securing tabs 186 extending perpendicularly from an inner side 188 of the body 184 at a first end 190 of the body 184. The body 184 also includes a plurality of second securing tabs 192 extending perpendicularly from the inner side 188 of the body 184 at a second end 194 of the body 184. The clip 34 may be fabricated from any of a number of materials, such as a plastic or metal material, and the clip 34 may be molded, stamped, formed and the like to include the securing tabs 186, 192. Alternatively, the securing tabs 186, 192 may be separately provided from, and secured to, the body 184. It is realized that the size, shape, material, and other characteristics of the clip 34 and the securing tabs 186, 192 may be different for different applications.

Figure 9:
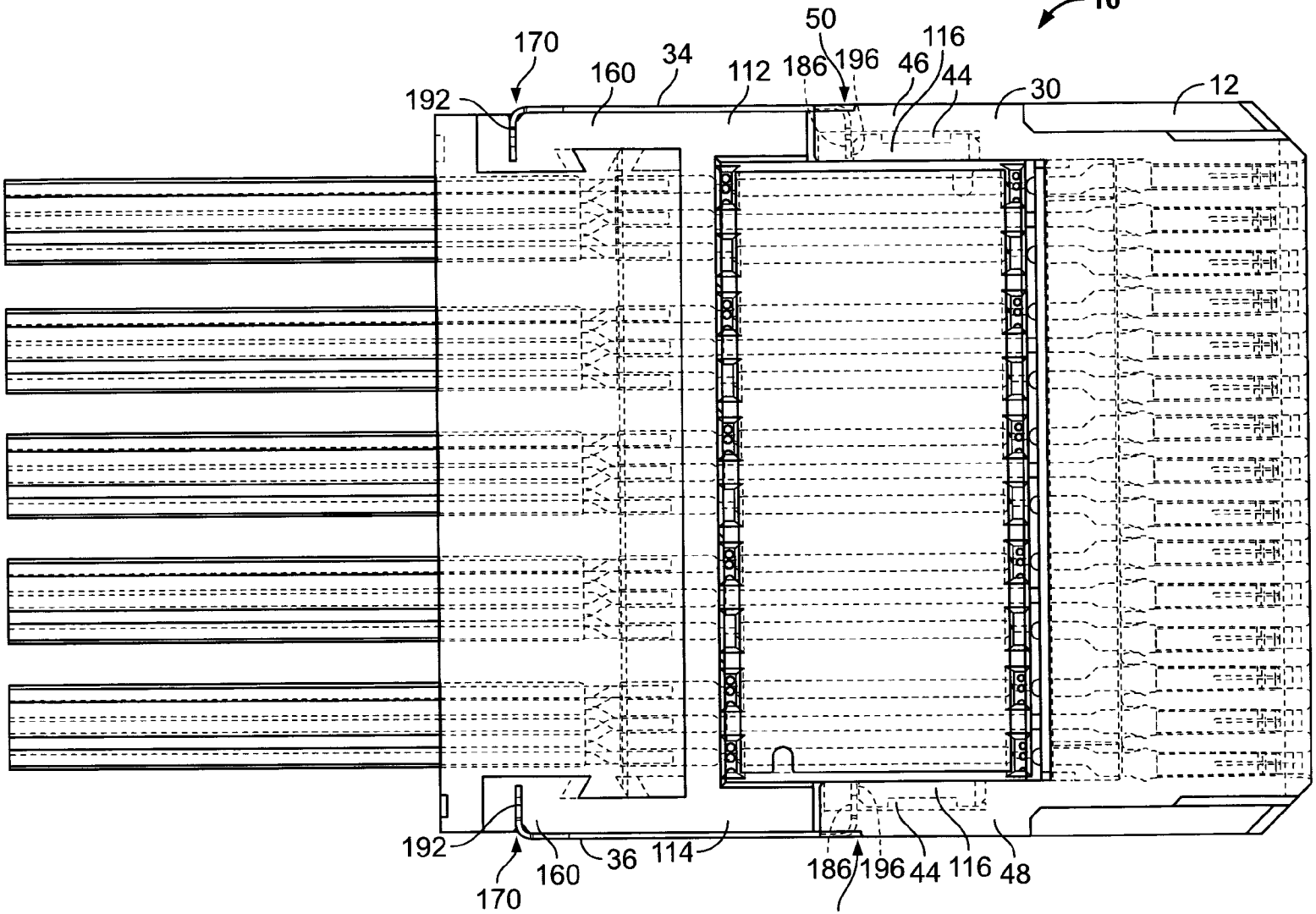
FIG. 9 illustrates the clip shown in FIG. 8 mated with the receptacle connector assembly.

FIG. 9 illustrates the clips 34, 36 in an assembled state with the receptacle connector assembly 10. Various components, or portions thereof, of the housing 12, contact module 30 and clips 34, 36 are illustrated in phantom. When assembled, the ribs 116 extending from the top and bottom ends 112, 114 of the contact module 30 are received within the slots 44 formed in the upper and lower hood portions 46, 48 of the housing 12. When the clips 34, 36 are coupled to the housing 12, the first securing tabs 186 are loaded into openings 50, 52 formed in the hood portions 46, 48, respectively. In an exemplary embodiment, at least a portion of the securing tabs 186 extend at least partially into the slots 44 and abut against a rear end 196 of the ribs 116. The securing tabs 186 thus restrict removal of the contact modules 30 from the housing 12. Additionally, the securing tabs 192 extend into the slots 170 (e.g. the first slot 174 and/or the second slot 176 shown in FIG. 7) in the contact modules 30. The clips 34, 36 resist outward deflection of the frame element 160, which resists removal of the insert portion 162 from the frame element 160.

Figure 10:
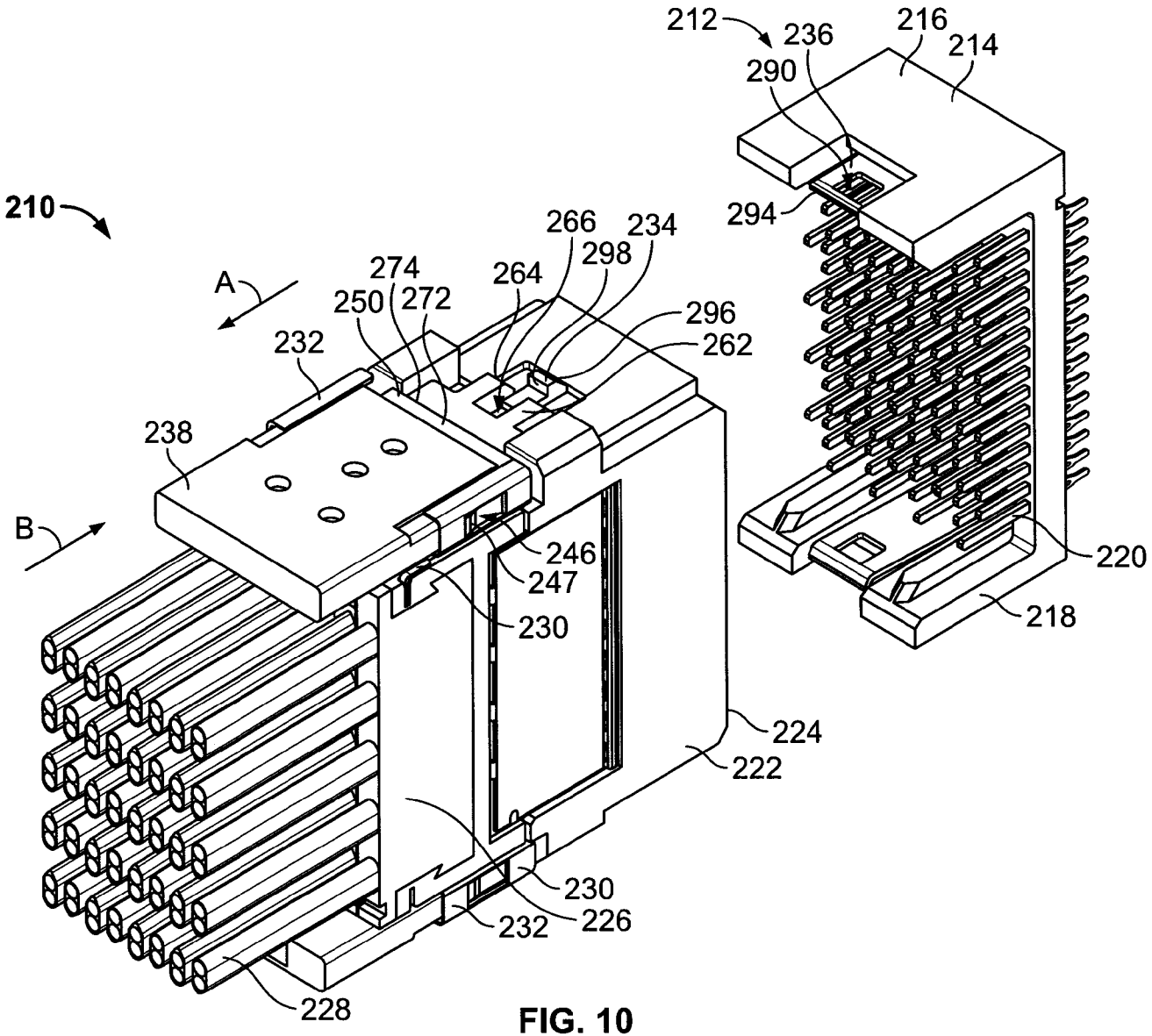
FIG. 10 is a rear perspective view of an alternative receptacle connector assembly formed in accordance with an alternative embodiment and a header connector assembly matable with the receptacle connector assembly.

FIG. 10 is a rear perspective view of an alternative receptacle connector assembly 210 formed in accordance with an alternative embodiment and a header connector assembly 212 matable with the receptacle connector assembly 210. The receptacle connector assembly 210 is similar to the receptacle connector assembly 10 in at least some respects. The header connector assembly 212 includes a housing 214 having top and bottom walls 216, 218 and a plurality of mating contacts 220. The mating contacts 220 are configured to mate with corresponding mating contacts of the receptacle connector assembly 210. In an exemplary embodiment, the mating contacts 220 are matable with a printed circuit board, such as a backplane or a daughterboard, and the like.

The receptacle connector assembly 210 includes a housing 222 having a mating interface 224 that mates with the header connector assembly 212. A plurality of contact modules 226 are loaded into the housing 222, and a plurality of cables 228 extend from the contact modules 226 and are coupled to the contact modules 226 in a similar manner as with the receptacle connector assembly 10. Clips 230 are used to secure the contact modules 226 to the housing 222 in a similar manner as the clips 34, 36. In an exemplary embodiment, the clips 230 (either one or both) include actuator retention features 232.

In an exemplary embodiment, the receptacle connector assembly 210 and the header connector assembly 212 are coupled to one another, such as by a latch. The receptacle connector assembly 210 includes a latching feature 234 configured to be securely coupled to a movable latch 236 on the header connector assembly 212. An actuator 238 is also provided for releasing the movable latch 236 from the latching feature 234. In an exemplary embodiment, the actuator 238 is slidably coupled to the receptacle connector assembly 210 and movable between a first position (such as the position illustrated in FIG. 10) and an actuated position. In operation, when the actuator 238 is moved from the first position to the actuated position, the latch 236 is moved by the actuator 238 from a locked position to a released position. The latch 236 is in locking engagement with the latching feature 234 when the latch 236 is in the locked position and the latch 236 is released from the latching feature 234 when the latch 236 is in the released position.

Figure 11:
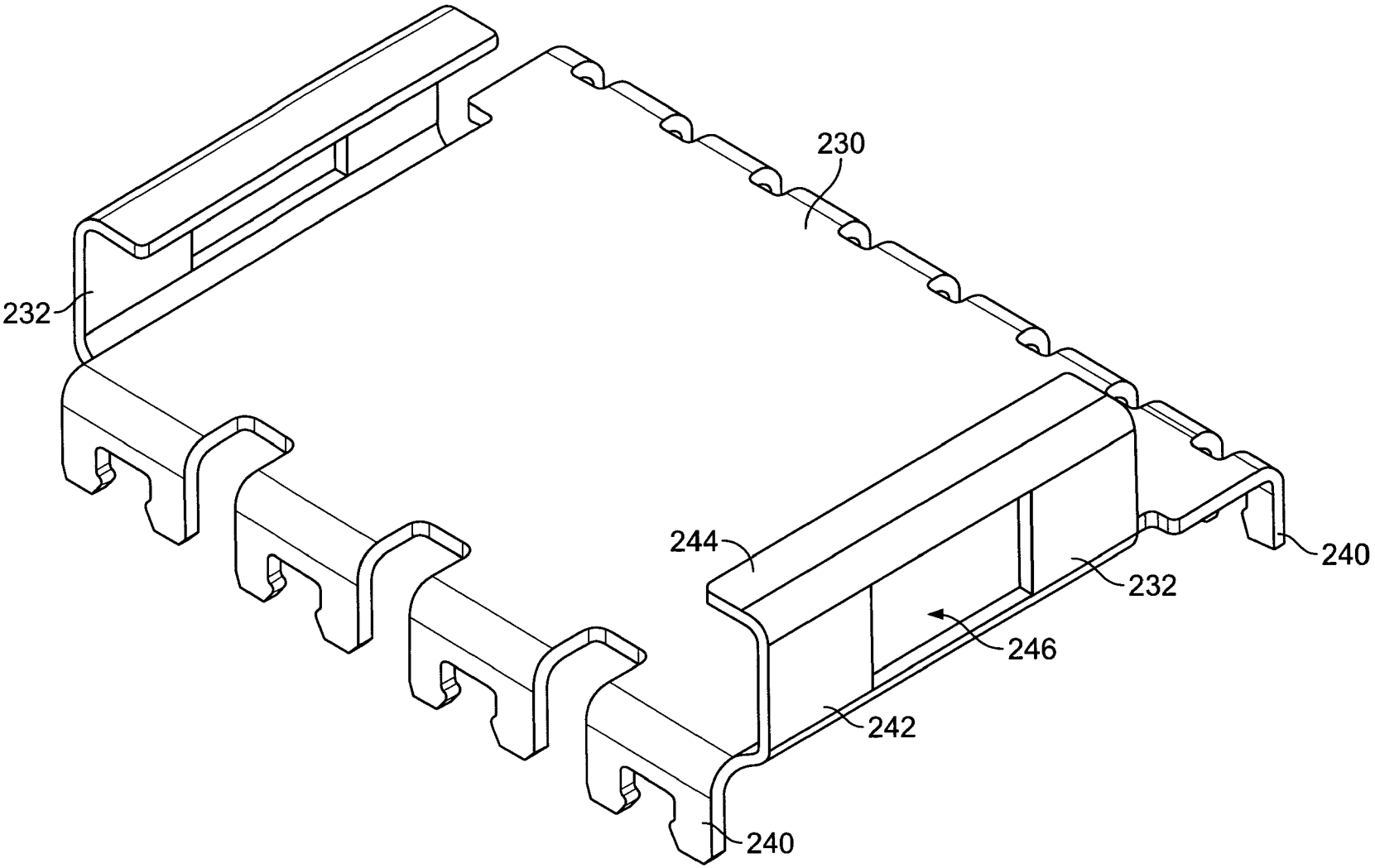
FIG. 11 illustrates a clip for use with the receptacle connector assembly shown in FIG. 10.

FIG. 11 illustrates the clip 230 for use with the receptacle connector assembly 210 (shown in FIG. 10). The clip 230 is similar to the clip 34, however, the clip 230 includes the actuator retention features 232 on opposite sides of the body of the clip 230. Optionally, the body of the clip 230 may be substantially planar to define a plate. The actuator retention features 232 generally define first and second brackets extending from the body of the clip 230 in a direction generally opposed to securing tabs 240 of the clip 230. The actuator retention features 232 each include an arm portion 242 extending generally perpendicularly from the body and a finger portion 244 extending generally perpendicular to the arm portion 242. The finger portions 244 are generally parallel to the body and are generally inwardly facing, such that the finger portions 244 face one another. When the actuator 238

(shown in FIG. 10) is mated with the clip 230, the finger portions 244 capture the actuator 238 and hold the actuator 238 in position with respect to the clip 230.

In an exemplary embodiment, the arm portions 242 include windows 246 extending longitudinally along the arm portions 242. As illustrated in FIG. 10, a tooth 247 of the actuator 238 is received within each of the windows 246. The windows 246 define a range of motion of the actuator 238 between the first and actuated positions. For example, the tooth 247 bottoms out against an edge of the window 246 when the actuator 238 is in the first position and/or the actuated position.

Figure 12:
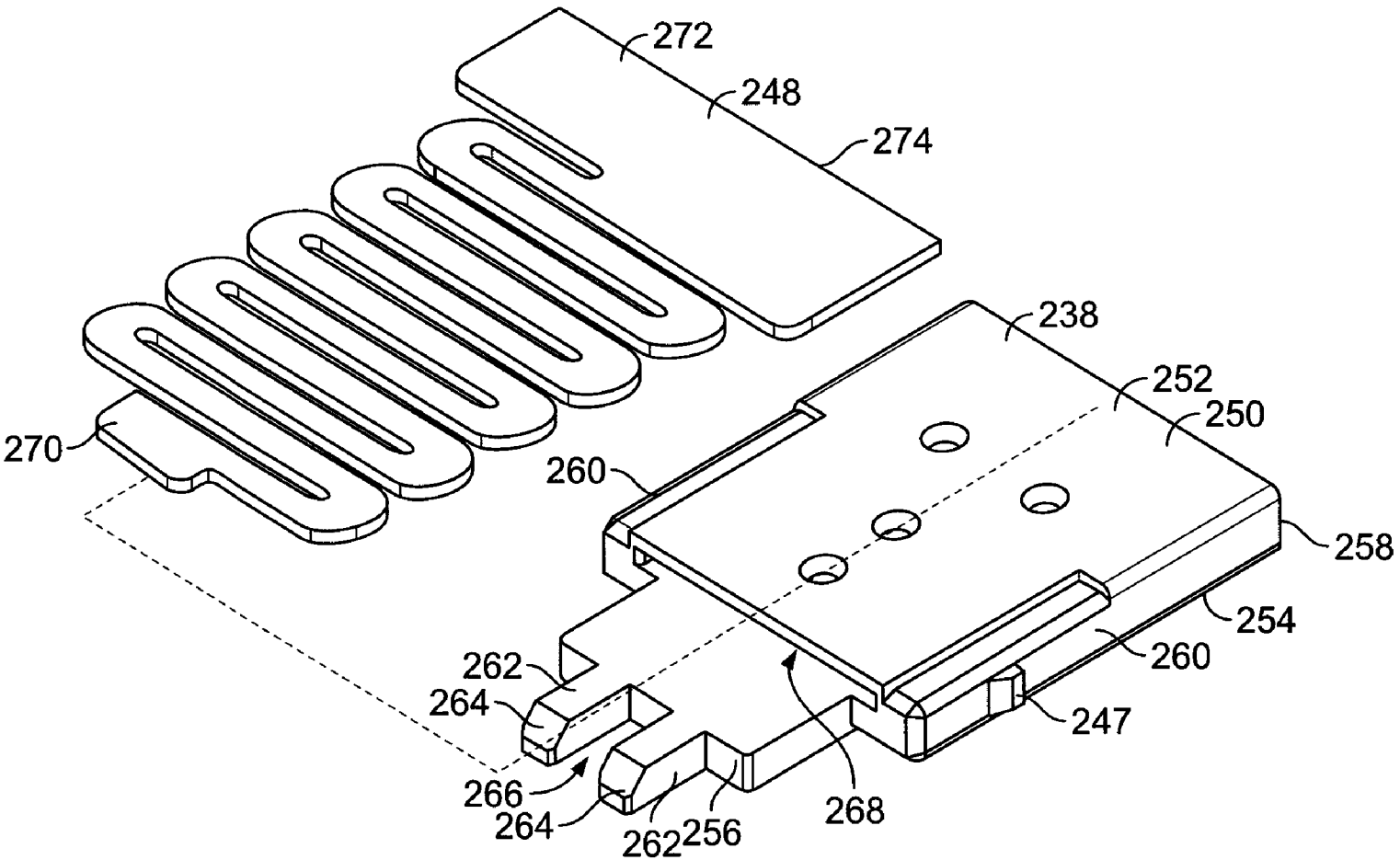
FIG. 12 illustrates an actuator for use with the receptacle connector assembly shown in FIG. 10.

FIG. 12 illustrates the actuator 238 for use with the receptacle connector assembly 210 (shown in FIG. 10) and a biasing element 248 for use with the actuator 238. The actuator 238 includes a body 250 having a top 252, a bottom 254, a front 256, a rear 258, and sides 260. The teeth 247 extend from opposed ones of the sides 260. In an exemplary embodiment, the actuator 238 includes a pair of legs 262 that extend from the front 256. The legs 262 have ramped feet 264 that are sloped between the bottom 254 and the top 252. A gap 266 is provided between the legs 262.

The actuator 238 also includes a chamber 268. In an exemplary embodiment, the chamber 268 is positioned proximate to the top 252 and opens to the front 256. The chamber 268 is sized, shaped and arranged to receive the biasing element 248. For example, a rear portion 270 of the biasing element 248 is received within the chamber 268 and a front portion 272 of the biasing element 248 is at least partially provided outside of the chamber 268. Referring back to FIG. 10, when assembled a biasing edge 274 of the front portion 272 engages the housing 222 of the receptacle connector assembly 210 and biases the actuator 238 in a rearward direction, shown by the arrow A.

Figure 13:
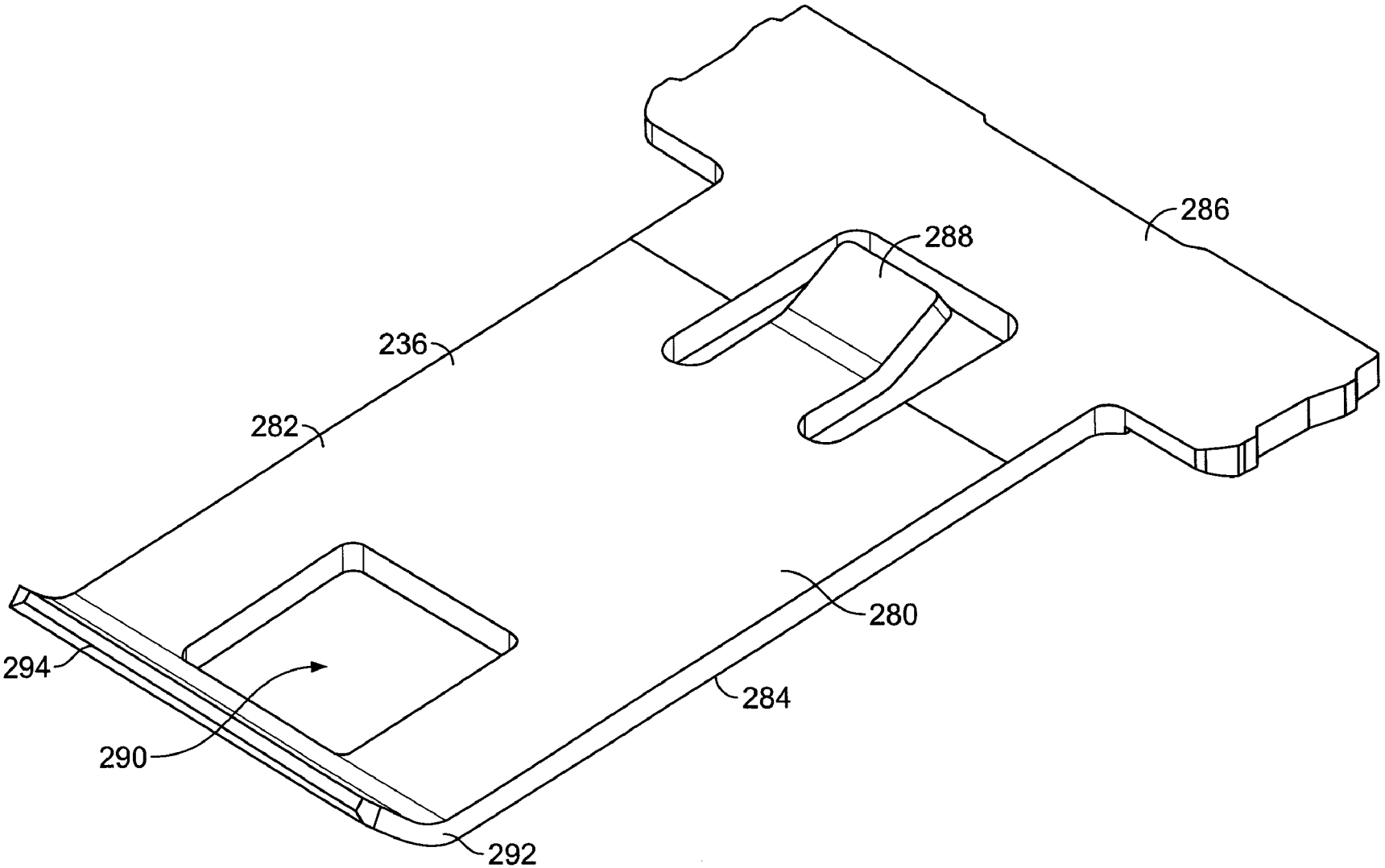
FIG. 13 illustrates a movable latch for use with the header connector assembly shown in FIG. 10.

FIG. 13 illustrates the movable latch 236 for use with the header connector assembly 212 (shown in FIG. 10). The latch 236 includes a body 280 having an outer surface 282 and an inner surface 284. The latch 236 includes a base 286 configured to be securely coupled to the header connector assembly 212, such as by a friction fit. A retention latch 288 is provided that extends generally outward (in the direction of the outer surface 282) and biases against the header connector assembly 210 to retain the body 280 in the header connector assembly 210. The latch 236 includes an opening 290 proximate to a distal end 292 of the latch 236, which is generally opposite the base 286. The opening 290 is configured to receive a portion of the latching feature 234 (shown in FIG. 10). A wing 294 is provided at the distal end 292 that is outwardly flared. The wing 294 is configured to engage the feet 264 of the actuator 238 (shown in FIG. 12).

An exemplary operation of the latching engagement between the receptacle connector assembly 210 and the header connector assembly 212 is described with reference to FIG. 10. The actuator 238 is coupled to the clip 230 by the actuator retention features 232. The biasing element 248 biases the actuator 238 to the first position, such as the position illustrated in FIG. 10. When assembled, the actuator 238 is positioned such that the latching feature 234 is aligned with the gap 266, and may be positioned at least partially within the gap 266 between the legs 262. The latching feature 234 includes a sloped forward surface 296. As the receptacle connector assembly 210 is mated with the header connector assembly 212, the wing 294 of the latch 236 engages the ramped forward surface 296 of the latching feature 234. The latch 236 is deflected outward until the receptacle connector assembly 210 and the header connector assembly 212 are mated, at which position, the latching feature 234 fits within the opening 290 of the latch 236. A rear surface 298 of the latching feature 234 engages an edge of the opening 290 and resists disengagement of the receptacle connector assembly 210 and the header connector assembly 212.

When de-coupling of the receptacle connector assembly 210 and the header connector assembly 212 is desired, the operator actuates the actuator 238 from the first position to the actuated position by forcing the actuator in an actuating direction, shown by the arrow B. When actuated, the legs 262 of the actuator 238, and more particularly, the feet 264, engage the wing 294 and lift the latch 236 outward. In the actuated position, the latch 236 clears the latching feature 234 and the receptacle connector assembly 210 can be pulled away from the header connector assembly 212. The biasing element 248 forces the actuator 238 from the actuated position to the first position when the actuator 238 is not forced to the actuated position by the operator.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

What is claimed is:

1. A connector assembly comprising:

a housing having support walls extending between a loading end and a mating end that defines a mating interface;

a contact module received within the housing through the loading end, the contact module includes a plurality of conductors and an overmolded body molded over the conductors, a portion of each conductor extending from an edge of the body to define contacts at a mating end of the conductors, portions of the conductors defining wire terminating ends configured to be terminated to individual wires, the body being configured to be molded over ends of the individual wires such that multiple wires extend from the body; and a clip having a first securing tab and a second securing tab, wherein the first securing tab is securely coupled to the housing and the second securing tab is securely coupled to the contact module, the clip securely retains the contact module within the housing.

2. The connector assembly of claim 1, wherein the first securing tab includes at least one tab extending from the clip proximate to a first end, and wherein the second securing tab includes at least one tab extending from the clip proximate to a second end.

3. The connector assembly of claim 1, wherein at least a portion of the contact module extends from the loading end of the housing and defines an exposed portion of the contact module, the clip extends along the exposed portion.

4. The connector assembly of claim 1, wherein the clip resists removal of the contact module from the housing in the direction of the wires.

5. The connector assembly of claim 1, wherein the body includes a rib extending outward therefrom, the rib is received in a slot in one of the support walls, the clip extends through the support wall and engages the rib.

6. The connector assembly of claim 1, further comprising a second contact module, the second securing tab engaging the contact module and the second contact module.

7. The connector assembly of claim 1, further comprising a second clip, the second clip being securely coupled to another support wall of the housing generally opposite to the clip, the second clip being securely coupled to the body of the contact module generally opposite to the clip.

8. A connector assembly comprising:

a housing having support walls extending between a loading end and a mating end, the mating end defining a mating interface;

a plurality of substantially identically formed contact modules received within the housing through the loading end, each contact module includes a body, a plurality of contacts, and a plurality of conductors electrically connected to corresponding contacts, the conductors being arranged as a leadframe, the body being overmolded over the conductors to hold the conductors, the conductors having a wire terminating end being configured to be terminated to individual wires, the conductors being arranged in sets of first, second and third conductors configured to operate in one of a signal-signal-ground conductor pattern and a ground-signal-signal conductor pattern; and commoning members separate from the contact modules, each commoning member being coupled to an outer side of a corresponding contact module, the commoning member being configured to be directly electrically connected to certain ones of the conductors defining ground conductors, wherein the commoning member defines the conductor pattern based on the particular conductors of the contact module that the commoning member engages, the orientation of the commoning member with respect to the body may be changed to change the conductor pattern.

9. The connector assembly of claim 1, wherein the conductors are arranged as a leadframe, the body being overmolded over the conductors to hold the conductors.

10. The connector assembly of claim 1, wherein the conductors are arranged in sets, each set of conductors having conductors carrying differential signals and defining a differential pair, the body holds more than one set of conductors.

11. A connector assembly comprising:

a first connector having a housing having support walls extending between a loading end and a mating end that defines a mating interface, and a contact module received within the housing through the loading end, the contact module having a body, a plurality of mating contacts extending from the body and a plurality of conductors held by the body and electrically connected to respective ones of the mating contacts, the conductors are configured to be terminated to individual wires of a cable, the first connector further having a clip coupled to the housing and coupled to the contact module to securely retain the contact module within the housing, the clip having an actuator retention feature, and the first connector further having a latching feature and an actuator movable with respect to the latching feature, the actuator being movably coupled to the actuator retention feature of the clip and movable between a first position and an actuated position; and a second connector having a second housing having a second mating interface matable with the mating interface of the first connector and a plurality of second mating contacts held within the housing for mating with the mating contacts of the first connector, the second connector further having a movable latch matable with the latching feature when the first and second connectors are joined;

wherein the latch is moved by the actuator from a locked position to a released position, the latch locking with the latching feature when the latch is in the locked position and the latch being released from the latching feature when the latch is in the released position.

12. The connector assembly of claim 11, wherein the clip includes a plate, the actuator retention feature extends outward from the plate.

13. The connector assembly of claim 11, wherein the actuator retention feature includes first and second brackets extending from opposite sides of the clip.

14. The connector assembly of claim 11, wherein the clip is separately provided from the housing and the contact module of the first connector.

15. The connector assembly of claim 11, wherein the actuator includes a tooth extending outward therefrom, the actuator retention feature includes a window extending along a length of the actuator retention feature, the tooth being received in the window and the window defining a range of motion of the actuator between the first and actuated positions.

16. The connector assembly of claim 11, further comprising a biasing element biasing the actuator toward the first position.

17. The connector assembly of claim 11, further comprising a first actuator and a first latching feature on a first side of the contact module, a second actuator and a second latching feature on a second side of the contact module, and first and second latches on opposite sides of the second housing.

18. The connector assembly of claim 8, wherein adjacent contact modules have different conductor patterns.

19. The connector assembly of claim 8, further comprising a clip coupled to the housing and coupled to each of the contact modules to securely retain the contact modules within the housing.

20. The connector assembly of claim 8, wherein the commoning member has a plurality of tabs extending through the body and engaging select ones of the conductors to electrically common such conductors.

* * * * *